US010320080B2

(12) United States Patent
Gendron et al.

(10) Patent No.: US 10,320,080 B2
(45) Date of Patent: Jun. 11, 2019

(54) TRI-BAND FEED ASSEMBLY SYSTEMS AND METHODS

(71) Applicant: Raytheon Company, Waltham, MA (US)

(72) Inventors: Craig D. Gendron, Holden, MA (US); Yueh-Chi Chang, Northborough, MA (US); Paul Finn, Framingham, MA (US); Alexander Brailovsky, Boxborough, MA (US)

(73) Assignee: Raytheon Company, Waltham, MA (US)

( * ) Notice: Subject to any disclaimer, the term of this patent is extended or adjusted under 35 U.S.C. 154(b) by 126 days.

(21) Appl. No.: 15/642,645

(22) Filed: Jul. 6, 2017

(65) Prior Publication Data

US 2019/0013587 A1 Jan. 10, 2019

(51) Int. Cl.

| | |
|---|---|
| ***H01Q 5/28*** | (2015.01) |
| ***H01Q 13/02*** | (2006.01) |
| ***H01Q 5/47*** | (2015.01) |
| ***H01P 1/161*** | (2006.01) |
| ***H01P 1/17*** | (2006.01) |

(52) U.S. Cl.

CPC ..... *H01Q 13/0258* (2013.01); *H01P 1/161* (2013.01); *H01P 1/172* (2013.01); *H01Q 5/28* (2015.01); *H01Q 5/47* (2015.01); *H01Q 13/0241* (2013.01)

(58) Field of Classification Search

CPC ..... H01Q 13/0258; H01Q 5/28; H01Q 5/47
See application file for complete search history.

(56) References Cited

U.S. PATENT DOCUMENTS

| | | | |
|---|---|---|---|
| 6,031,434 | A | 2/2000 | Tatomir et al. |
| 8,537,068 | B2 | 9/2013 | Martin et al. |
| 2002/0044097 | A1 | 4/2002 | Yuanzhu |
| 2011/0181479 | A1 | 7/2011 | Martin et al. |

OTHER PUBLICATIONS

Targonski, "A Multiband Antenna for Satellite Communications on the Move;" IEEE Transactions on Antennas and Propagation, vol. 54, No. 10; Oct. 2006; 7 Pages.*

PCT International Search Report and Written Opinion dated Apr. 18, 2018 for International Application No. PCT/US2018/018090; 15 Pages.

Targonski; "Design of a Multiband Antenna for Satellite Communications on the Move"; 2004 Antennas and Propagation Society International Symposium; Jun. 20-25, 2004; 4 Pages.

* cited by examiner

*Primary Examiner* — Graham P Smith
(74) *Attorney, Agent, or Firm* — Daly, Crowley, Mofford & Durkee LLP

(57) ABSTRACT

A feed assembly for that operates at different frequency bands (e.g., low, mid and high frequency bands) is provided herein. The feed assembly includes a feed horn common to low, mid and high frequency bands, a coaxial polarizer to launch signals in the low band frequency band, a coaxial orthomode transducer (OMT) to launch signals in the low band frequency band and supports the mid and high frequency bands, and a polyrod disposed in a center conductor of the feed assembly, the polyrod common to the mid and high frequency bands. The feed assembly includes a tri-band feed assembly having different portions to support signals in the low frequency band and signals in the mid and high frequency bands.

25 Claims, 11 Drawing Sheets

TRI-BAND FEED ASSEMBLY SYSTEMS AND METHODS

BACKGROUND

As is known in the art, conventional SATCOM terminals utilize small or low profile reflector antennas in applications having significant size constraints. The small or low profile reflector antennas typically include a feed assembly that transmits signals from a transmitter or receives signals to a receiver in the respective antenna system. However, the size of the feed assembly can limit the type of SATCOM applications the small or low profile reflector antennas can be utilized in. Further, many feed assemblies are only configured to provide and support single-band or dual-band operation.

SUMMARY

The concepts, systems and techniques disclosed herein provide a compact tri-band feed assembly for that operates at first, second and third frequency bands (e.g., low, mid and high frequency bands) and can be utilized in various reflector antenna applications. The tri-band feed assembly includes various components to provide a feed assembly having smaller dimensions as compared with feed assemblies known in the art. For example, in some embodiments, the feed assembly includes a compact feed horn and a compact match section that support low, mid and high frequency bands, a coaxial polarizer and an orthomode transducer (OMT) to support signals in a low frequency band, a polyrod and polarizer in a center conductor using circular waveguide to support signals in mid and high frequency bands, and a diplexer to separate one or more mid-band ports to a high-band port. Thus, the feed assembly provides a tri-band feed assembly having different portions to support signals in the low frequency band and signals in the mid and high frequency bands.

The tri-band feed assembly can be designed for relatively small or low profile reflector antennas for applications, such as, but not limited to, airborne, shipboard, or ground mobile platforms, having limited space for the respective reflector antennas. The components of the tri-band feed assembly can have smaller (e.g., compact) dimensions as compared to comparable components of other feed assemblies known in the art. For example, a length of the coaxial polarizer can be approximately equal to one-half a wavelength at a frequency of operation in the low frequency band. In embodiment, the coaxial polarizer includes one or more portions having a notched rectangular shape. In some embodiments, the reduced size can be achieved based at least in part on the properties of the one or more portions having a notched rectangular shape and the properties of the material used to form the coaxial polarizer.

The OMT can have compact dimensions such that two low band ports are disposed in close proximity but orthogonal to each other. In the coaxial waveguide, a pair of shorting fins are used to provide additional isolation between the two orthogonal ports. The distance between the two ports can be adjusted based on a return loss threshold and an isolation threshold of a respective reflector antenna.

Two key challenges of multi-band feed design for reflector antenna are having similar beamwidths and having a common phase center for all bands. With different beamwidths, antenna illumination or spillover efficiency will be compromised. Without having a common phase center, antenna phase efficiency will be compromised. The physics for a feed horn is that it usually has broader beamwidth at lower frequency and it becomes narrower as frequency increases. Most of the feed horns also have phase center locations vary with frequency. In embodiments, the respective beamwidths of the feed assembly at each of the low, mid and high frequency bands are approximately equal. For example, in some embodiments, the beamwidths (e.g., 10-db beam widths) for each of the low, mid and high frequency bands can be about 74 degrees. In embodiment, the feed assembly has a common phase center for each of the low, mid and high frequency bands to provide high antenna efficiencies at each of the low, mid and high frequency bands.

In a first aspect, a feed assembly for a reflector antenna is provided having a feed horn common to low, mid and high frequency bands, a coaxial polarizer to launch signals in the low band frequency band and supports the mid and high frequency bands, a coaxial orthomode transducer (OMT) to launch signals in the low band frequency band and supports the mid and high frequency bands, and a polyrod disposed in a center conductor of the feed assembly, the polyrod common to the mid and high frequency bands and supports the low frequency band.

A length of the coaxial polarizer may correspond to one-half a wavelength at an operating frequency in the low frequency band. In some embodiments, the length of the coaxial polarizer corresponds to properties of a material forming the coaxial polarizer and a shape of the coaxial polarizer. The coaxial polarizer may include a portion having a notched rectangular shape.

The coaxial OMT further can include at least two ports disposed at a predetermined distance from each other. The predetermined distance may correspond to a return loss threshold and an isolation threshold of the reflector antenna.

The feed assembly may include a matching section coupled to the feed horn that is common to the low, mid and high frequency bands. A polarizer can be disposed in the center conductor of the feed assembly, the polarizer common to the mid and high frequency bands. The feed assembly can include a diplexer configured to separate a first and second port for mid frequency bands from a third port for high frequency bands.

In an embodiment, the respective beamwidths (e.g., 10-dB beamwidths) for the low, mid and high frequency bands is approximately equal. For example, the respective 10-dB beamwidths can be about 74 degrees. The feed assembly can include a co-located phase center for launching signals in the low, mid and high frequency bands.

In another aspect, a method is provided comprising receiving and transmitting signals using a feed assembly for a reflector antenna at low, mid and high frequency bands, providing a feed horn common to the low, mid and high frequency bands, launching signals in the low frequency band using a coaxial polarizer and a coaxial orthomode transducer (OMT), and launching signals in the mid and high frequency band using a polyrod and a diplexer, wherein the polyrod and the diplexer support the low frequency band.

The method may include providing the coaxial polarizer at a length that corresponds to one-half a wavelength of an operating frequency in the low frequency band. In some embodiments, the length of the coaxial polarizer corresponds to properties of a material forming the coaxial polarizer and a shape of the coaxial polarizer.

A portion of the coaxial polarizer can be formed having a notched rectangular shape. First and second ports can be disposed at a predetermined distance corresponding to a return loss threshold and an isolation threshold of the reflector antenna.

In some embodiments, a polarizer can be provided in a center conductor of the feed assembly. The polarizer can be common to the mid and high frequency bands. The diplexer can be configured to separate first two ports for mid frequency bands from a third port for high frequency bands.

The respective 10-dB beamwidths for the low, mid and high frequency bands can be approximately equal. In some embodiments, the respective beamwidths are about 74 degrees. The feed assembly can be configured to have a co-located phase center for launching signals in the low, mid and high frequency bands.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Described herein is a tri-band feed assembly for that operates at multiple different frequency bands (e.g., low, mid and high frequency bands) that can be utilized in various satellite communications (SATCOM) applications, such as reflector antenna applications. In embodiments, the tri-band feed assembly comprises multiple portions having smaller (or compact) dimensions as compared with similar components of other feed assemblies known in the art. Thus, the tri-band feed assembly can be applied in small or low profile reflector antenna applications, such as but not limited to, airborne, shipboard or ground mobile platforms having limited real estate. The different components of the tri-band feed assembly can be configured to support one or more different frequency bands such that the respective beamwidths for the different frequency bands are approximately equal and maintain a common phase center for each of the different frequency bands.

In embodiments, the low, mid, and high bands that make up the tri-bands of the feed include K (20.2-21.2 GHz), Ka (30-31 GHz), and Q (43.5-45.5 GHz) bands, respectively. It should be appreciated that while a tri-band feed is described herein, it is understood that additional frequency bands can use one or components of the tri-band feed assembly described herein. The terms "common" and "support" can refer to the ability of a component of the feed assembly to perform an operation on, receive and/or transmit signals in the respective frequency band. In some embodiments, an operation may include conveying or transitioning signals to other components in the feed assembly. Components of the feed assembly may include, but not limited to, a feed horn, matching section, coaxial polarizer, coaxial OMT, polarizer, diplexer and center conductor.

Figure 1:
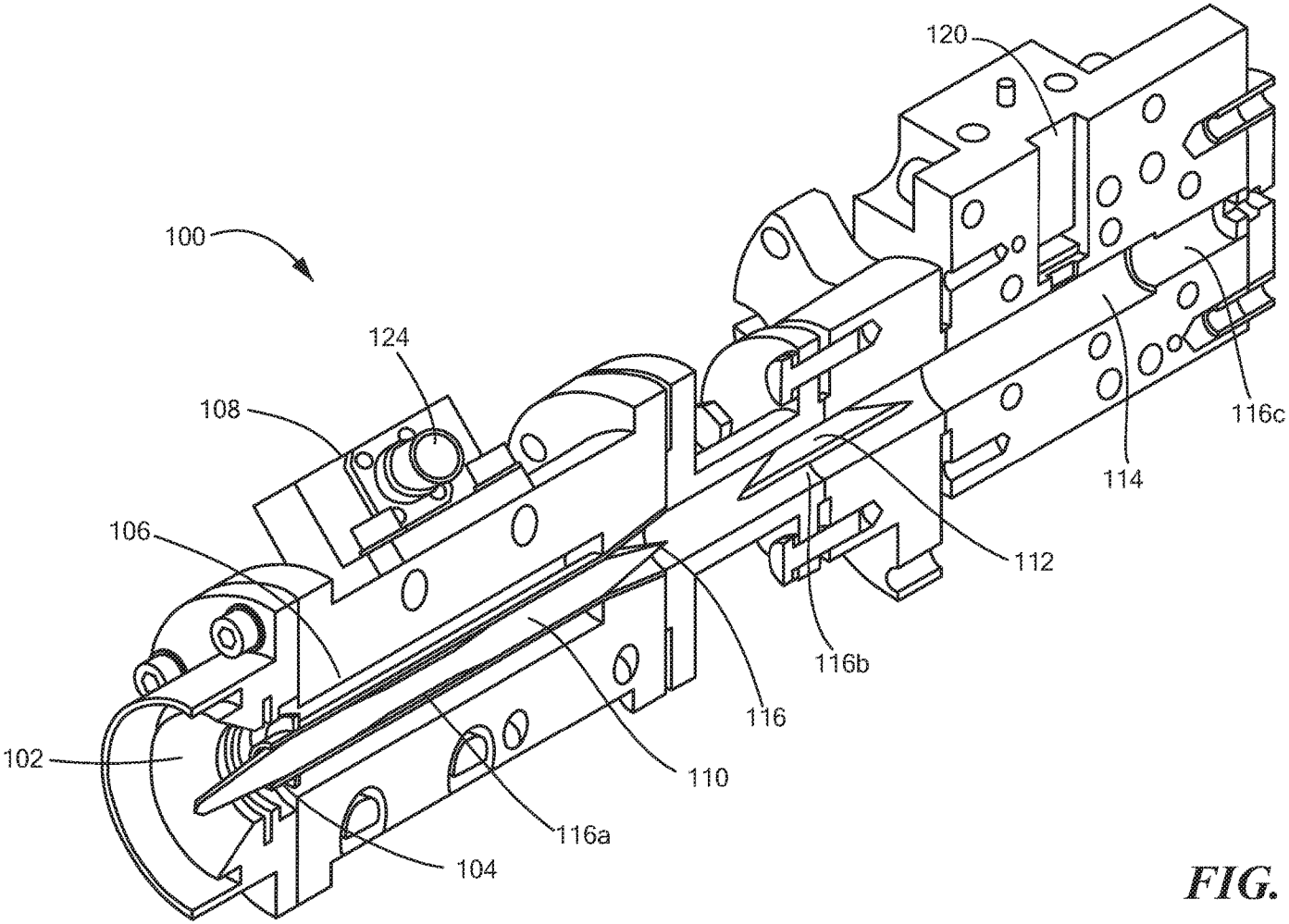
FIG. 1 is a cut-away view of a tri-band feed assembly.

Referring now to FIG. 1, a tri-band feed assembly 100 includes a feed horn 102, a matching section 104, a coaxial polarizer 106, a coaxial orthomode transducer (OMT) 108, a polyrod 110, a polarizer 112, and a diplexer 114. In the illustrative embodiment, the low, mid, and high bands that make up the tri-bands of the feed include K (20.2-21.2 GHz), Ka (30-31 GHz), and Q (43.5-45.5 GHz) bands, respectively.

Figure 3:
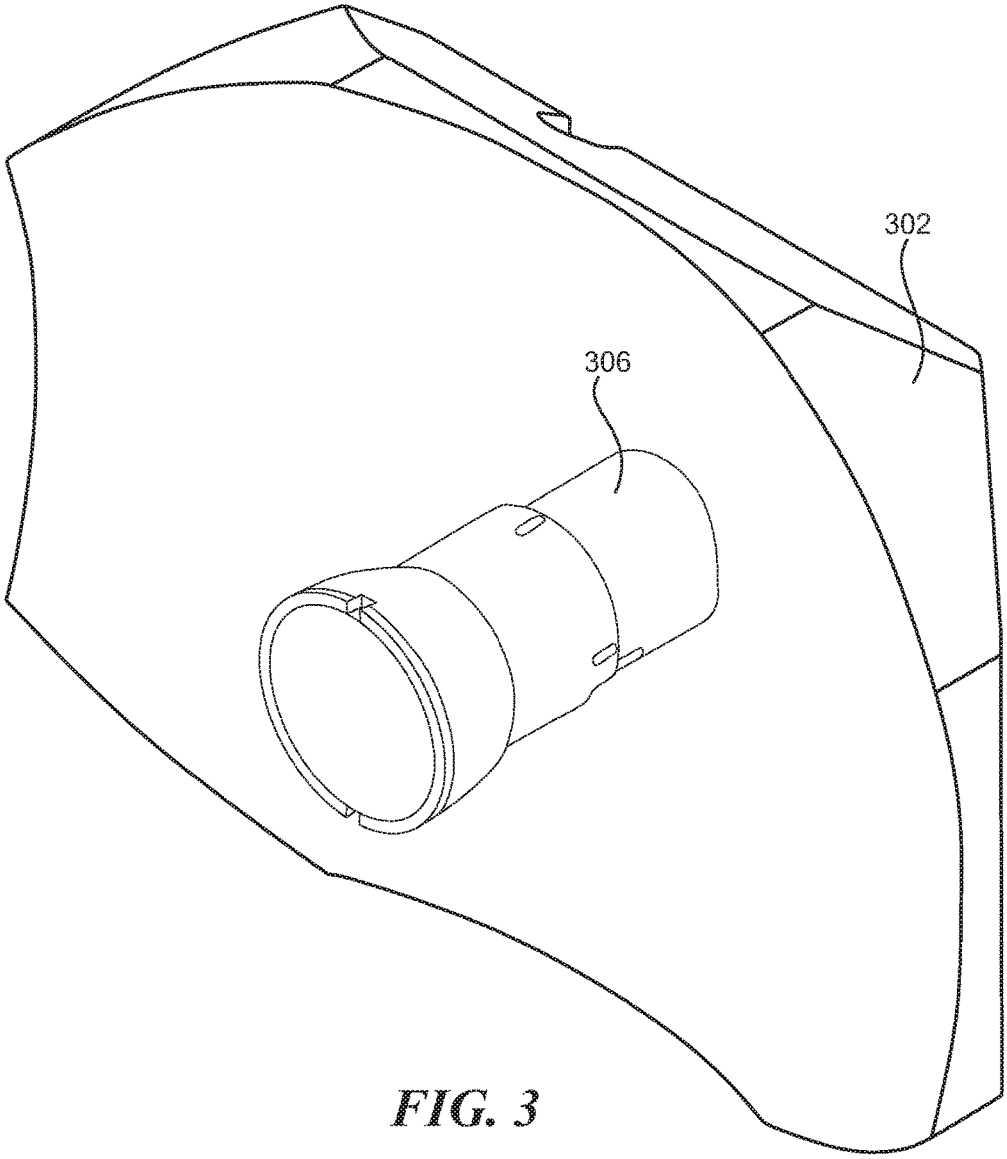
FIGS. 3-3B are different views of the tri-band feed assembly of FIG. 1 coupled to a reflector antenna.
Figure 3A:
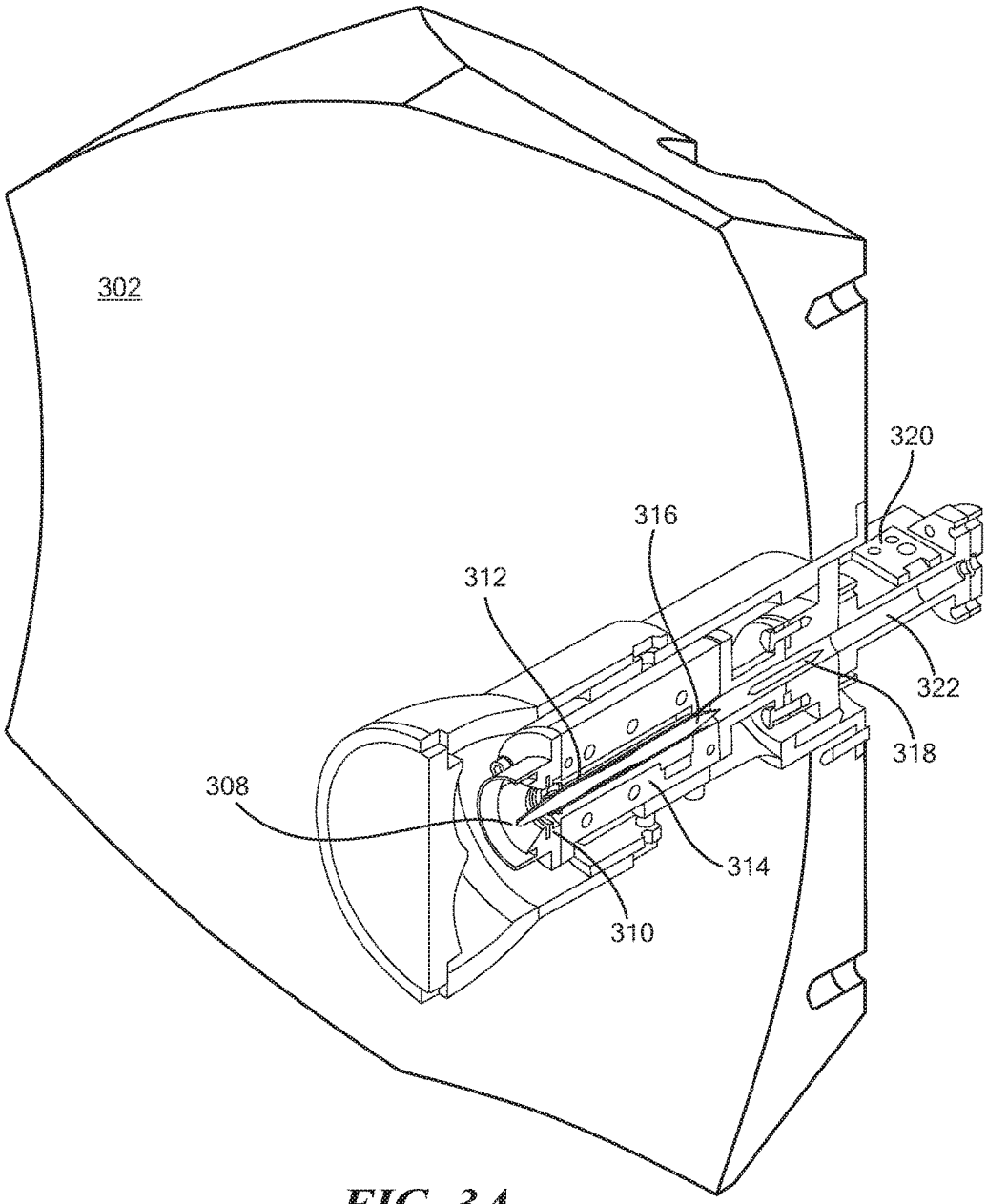

Feed horn 102 may be coupled to a reflector antenna (not shown, such as reflector antenna 302 of FIG. 3). In an embodiment, feed horn 102 can receive signals from the reflector antenna and convey the signals to other components within feed assembly 100. Feed horn 102 can include a tri-band feed horn and can be configured to receive and transmit signals at low, mid and high frequency bands.

Matching section 104 may be disposed in an inner cavity/channel of feed horn 102. In an embodiment, matching section 104 may include a dielectric ring sandwiched between two metallic iris rings to provide impedance matching between the feed and free space where the transmitted signal is radiated into or the received signal is coming from. Matching section 104 is configured to support each of the low, mid and high frequency bands.

Coaxial polarizer 106 is disposed within an inner cavity of feed assembly 100 and is configured to launch signals in a low frequency band. In some embodiments, one or more coaxial polarizers are coupled to a center conductor 116 disposed in the inner cavity of feed assembly 100. Coaxial polarizer 106 can have a length of one-half a wavelength of frequencies (e.g., operating frequency) in the low frequency band. The length can correspond to properties of a material forming the coaxial polarizer and a shape of the coaxial polarizer. Coaxial polarizer 106 will be described in greater detail with respect to FIGS. 2-2A below.

Coaxial OMT 108 is coupled to feed horn 102 and can be disposed around center conductor 116 and coaxial polarizer 106. Coaxial OMT 108 can include one or more ports (here one port 124 is shown) to launch signals in the low frequency band. In some embodiments, the ports may include left-hand and/or right-hand circular polarization ports. Coaxial OMT 108 can be formed having a compact shape such that the ports can be disposed at a reduced distance from each. The reduced (or predetermined) distance can be selected based at least in part on a return loss threshold and an isolation threshold of the reflector antenna. Coaxial OMT 108 may include a pair of shorting fins that are used to provide additional isolation between the two orthogonal ports. In each of the two orthogonal ports, a wedge section is used to provide compact transition from the coaxial waveguide to rectangular waveguide, which also serves as a matching section for the transition. Coaxial OMT 108 will be described in greater detail with respect to FIGS. 2 and 2C-2D below.

Polyrod 110 is disposed within center conductor 116. In the illustrative embodiment of FIG. 1, polyrod 110 is disposed within a first (end) portion 116*a* of center conductor 116 such that a first end 110*a* extends into feed horn 102 to launch the signal from center conductor 116 and a second end 110*b* is disposed proximate to polarizer 112. The second end 110*b* can be started within a taper circular waveguide section that reduce the diameter with dielectric loading provided by the polyrod. In an embodiment, this dielectric loading can be utilized to support proper inner diameter for the coaxial waveguide. Polyrod 110 can be configured to launch signals in mid and high frequency bands.

Polarizer 112 is disposed within a second (middle) portion 116*b* of center conductor 116. Polarizer 112 can be configured to launch signals in mid and high frequency bands. Polarizer 112 can be configured to convert a linearly polarized wave into a circular polarized wave, or a circular polarized wave into a linearly polarized wave. Polarizer 112 can be configured to apply a phase differential or a phase shift (e.g., 90° phase shift) for the conversion. Polarizer 112 can be configured to launch signals in mid and high frequency bands.

Diplexer 114 is can be disposed proximate to polarizer 112 and can be configured to launch signals in mid and high frequency bands. In an embodiment, a third (end) portion 116*c* of center conductor 116 can disposed within and extend through diplexer 114. As is known in the art, a waveguide diplexer is a device for combining/separating multi-band and multi-port signals to provide band or polarization discrimination. Diplexer 114 can include one or more ports to separate mid band ports and high band ports to launch signals in the respective frequency bands. For example, and as illustrated in FIG. 1, diplexer 114 can include first two ports 120 (although one port is shown for clarity) for signals in the mid frequency band and a third port (e.g., second port 122 of FIG. 1B) for signals in the high frequency band. It should be appreciated that the number of ports and properties of the diplexer can based at least in part on a particular application of feed assembly 100. For example, in one embodiment, diplexer may include a four-port diplexer to separate two mid-band ports and two high-band ports.

Figure 1A:
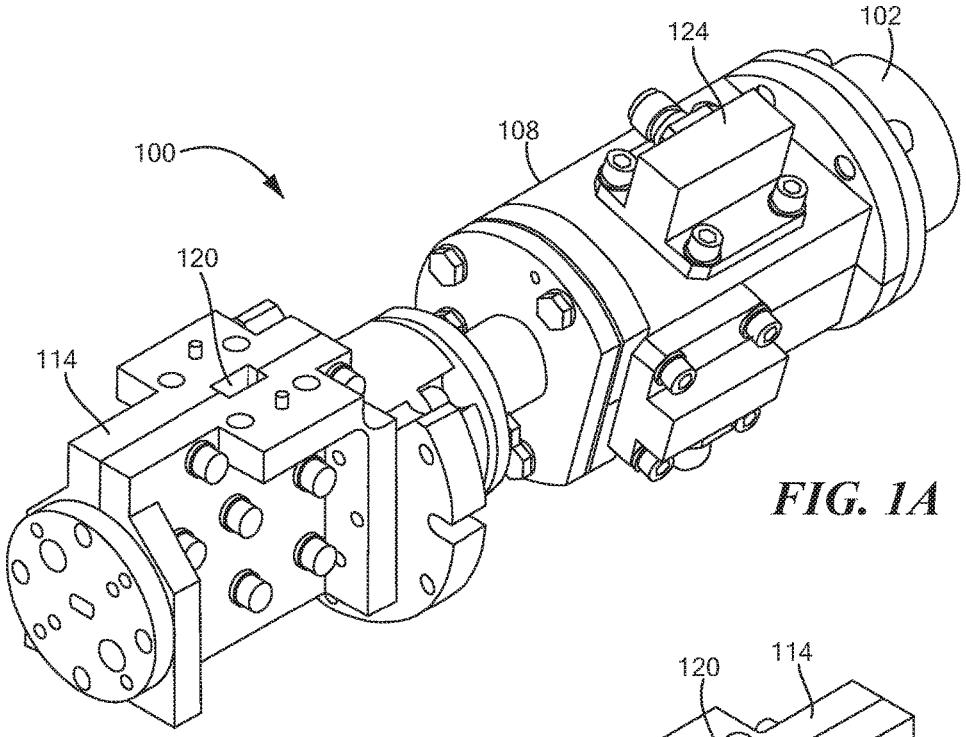
FIGS. 1A-1B are two isometric views of the tri-band feed assembly of FIG. 1.
Figure 1B:
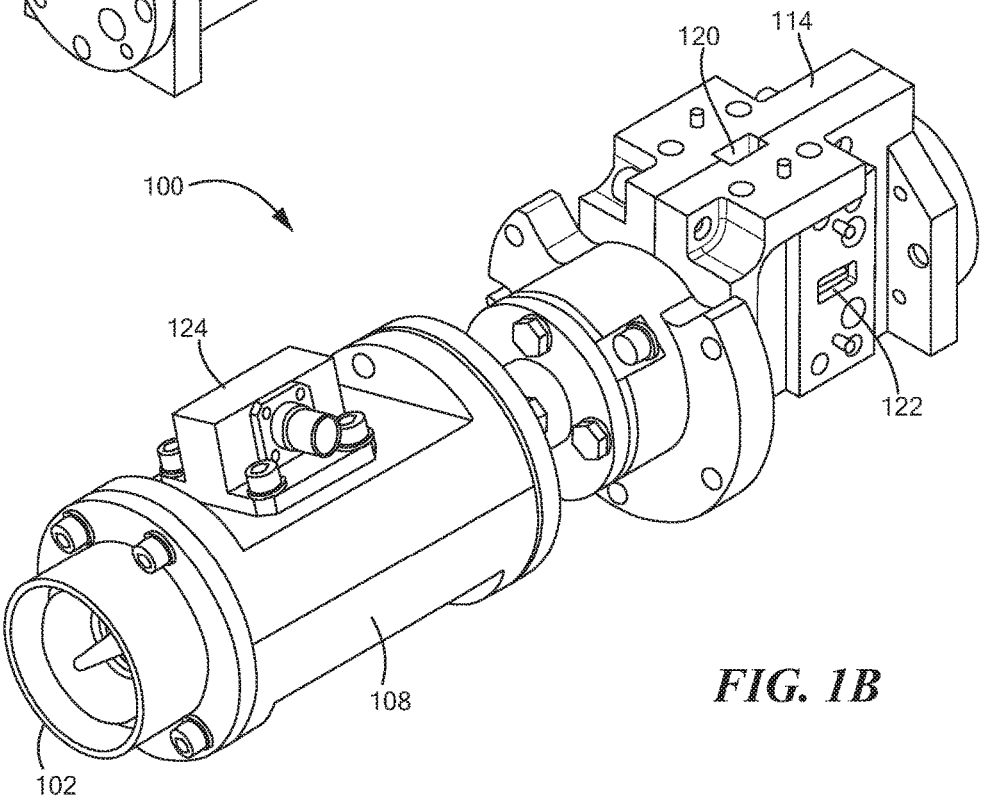

Briefly referring to FIGS. 1A-1B, alternate views of feed assembly 100 are provided illustrating the entire feed assembly coupled together (i.e., two portions of feed assembly 100 coupled together). As illustrated in FIGS. 1A-1B, feed horn 102, coaxial OMT 108 having a port 126, and diplexer 114 having a first port 120 (e.g., mid band port) and a second port 122 (e.g., high band port) are shown. Matching section 104, coaxial polarizer 106, polyrod 110, polarizer 112 and center conductor 116 are not shown in FIGS. 1A-1B, as they are disposed within an inner cavity of feed assembly 100.

Figure 2:
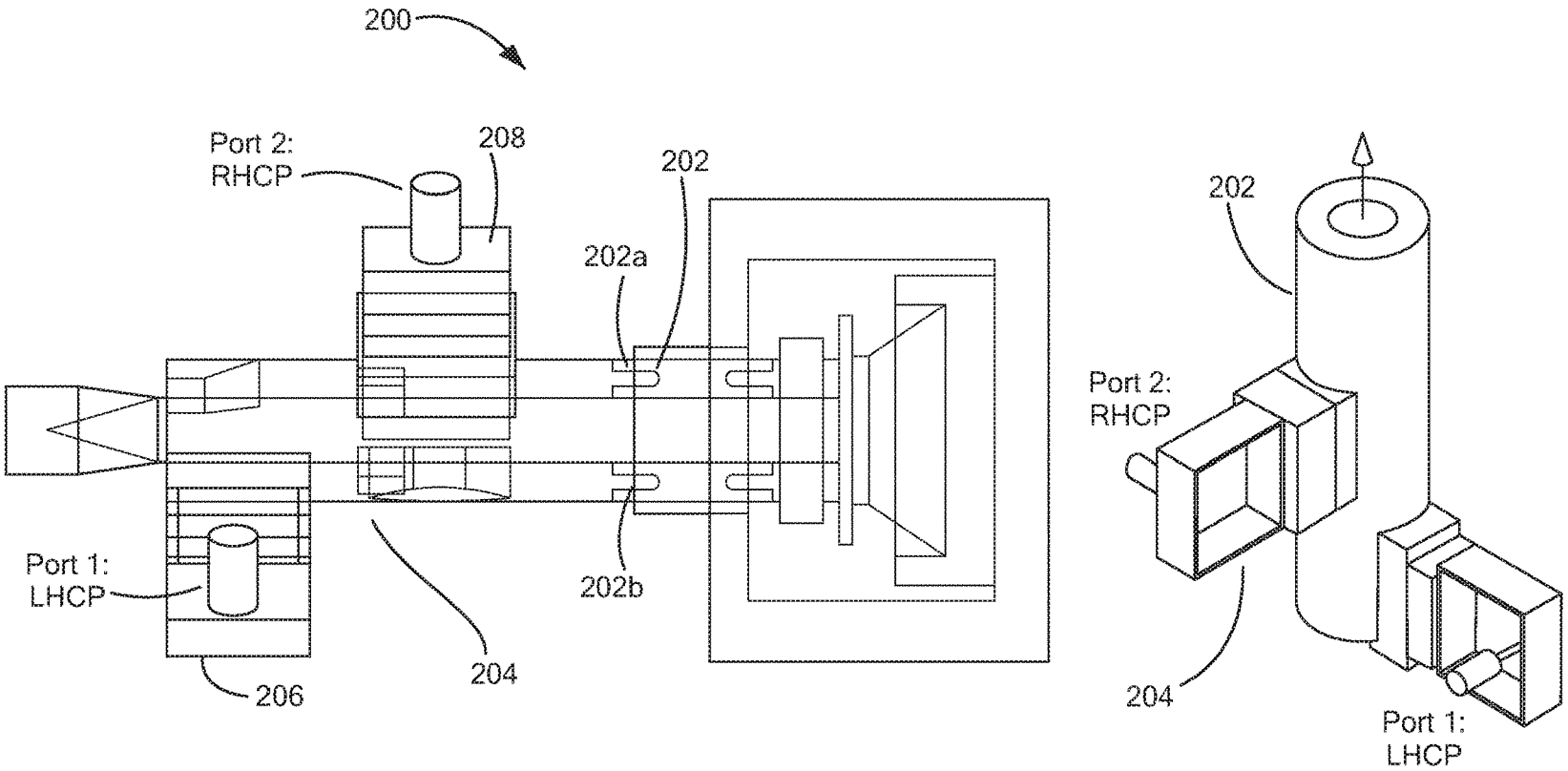
FIG. 2 is a cut-away view of two coaxial polarizers and a coaxial orthomode transducer (OMT) of the tri-band feed assembly of FIG. 1.
Figure 2A:
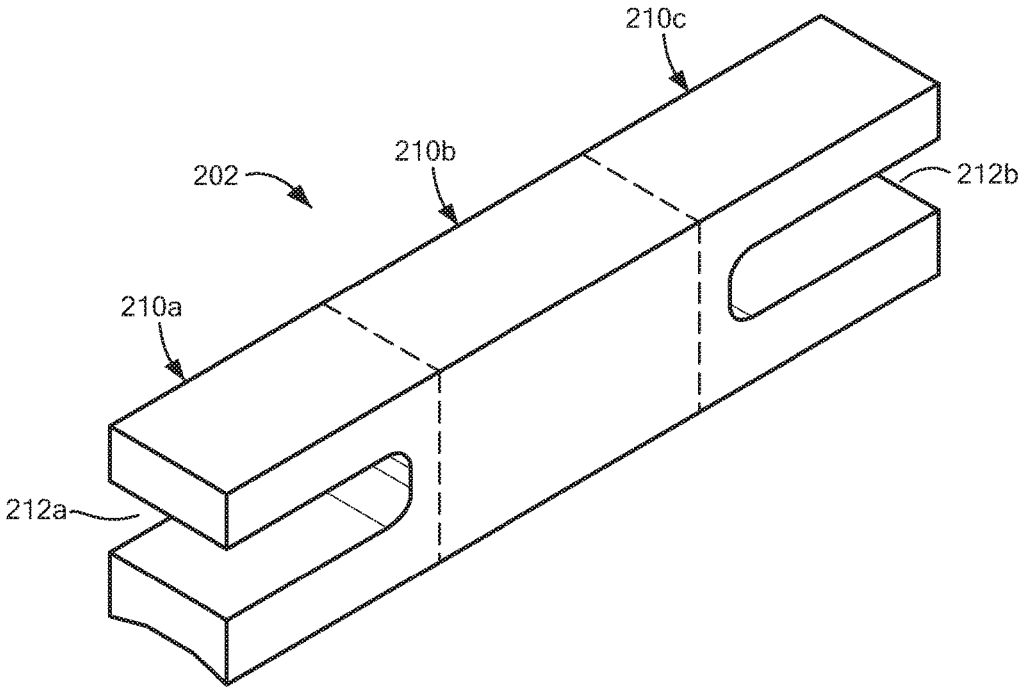
FIGS. 2A-2B are cut-away views of the coaxial polarizer of the tri-band feed assembly of FIG. 1.
Figure 2B:
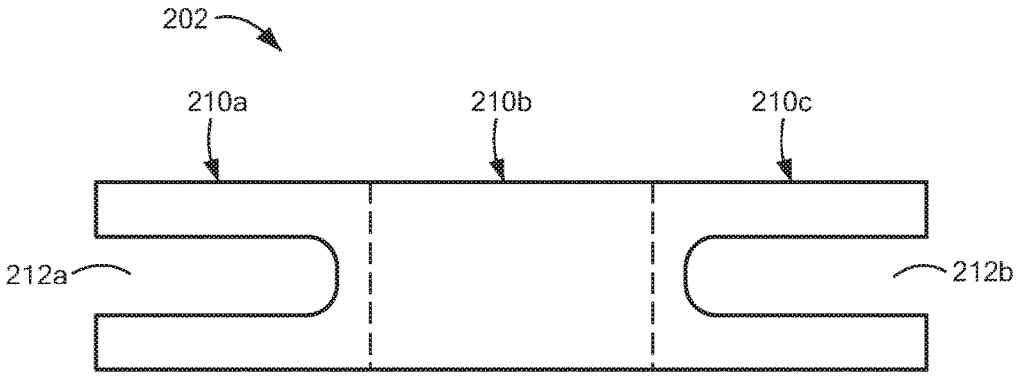
Figure 2D:
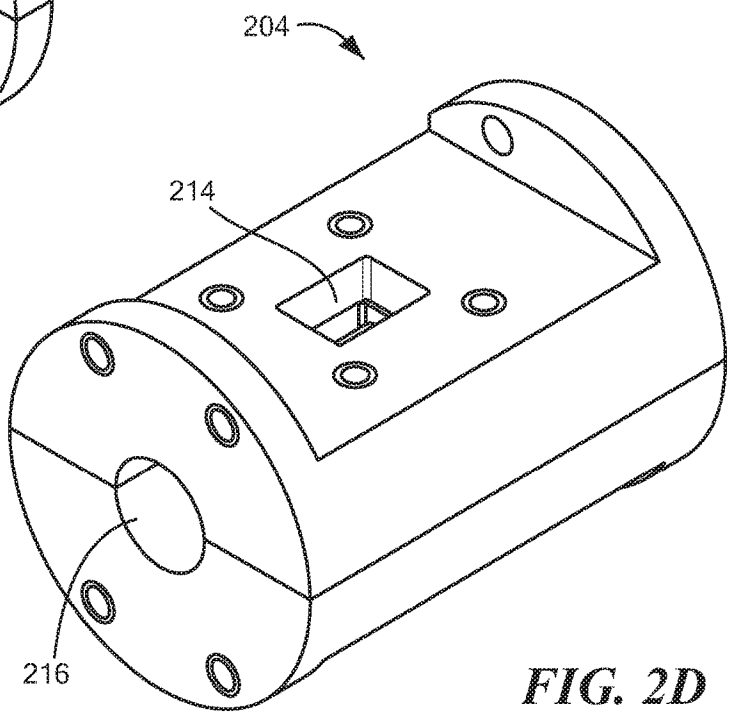
FIGS. 2C-2D are isometric views of the coaxial OMT of the tri-band feed assembly of FIG. 1.
Figure 2C:
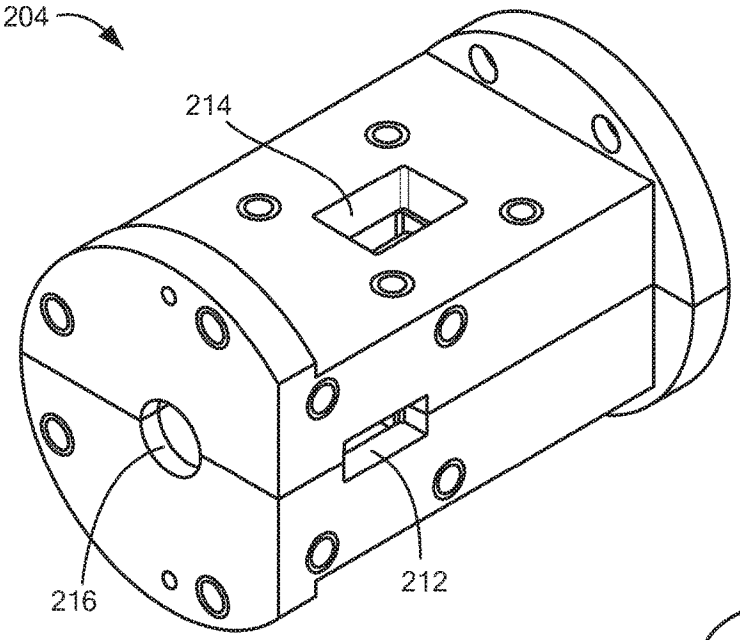

Referring now to FIGS. 2-2C, a first coaxial polarizer 202*a* and a second coaxial polarizer 202*b* are coupled to a coaxial OMT 204 having a first OMT port 206 and a second OMT port 208. Coaxial polarizers 202*a*, 202*b* and coaxial OMT 204 may be the same or substantially similar to coaxial polarizer 106 and coaxial OMT 108 of FIG. 1, respectively.

First and second coaxial polarizers 202*a*, 202*b* and coaxial OMT 204 can be provided having compact dimensions as compared with other polarizers and OMTs known in the art. In embodiments, a length of each of first and second coaxial polarizers 202*a*, 202*b* can be approximately one-half a wavelength at frequencies (e.g., operating frequency) in the low frequency band. The reduced length can be based at least in part on a shape of the respective coaxial polarizer 202*a*, 202*b* and/or properties of the material forming the respective coaxial polarizer 202*a*, 202*b*. For example, a vain polarizer, as is known in the art, can utilize taper shape to provide good impedance matching while slow down the E-field to provide 90-degree phase shift. However, first and second coaxial polarizers 202*a*, 202*b* (and other polarizers include a notched region (and other polarizers described herein having a notched shape or notched region). The notched shape can provide sufficient phase shift and/or good matching within a polarizer of a shorter length, as compared to a polarizer not having a notched shape. It should be appreciated that with the same length, the notched regions can have more dielectric material than, for example, a tapered section. Thus, the overall length of first and second coaxial polarizers 202*a*, 202*b* can be reduced by including one or more notched regions. Further, first and second coaxial polarizers 202*a*, 202*b* can include high-k dielectric material having a high dielectric constant (e.g., Hi-K material) to further shorten their respective lengths from other types of vane polarizers having material such as Rexolite or Teflon with a dielectric constant from 2.1 to 2.54.

For example, and now referring to FIGS. 2A-2B, coaxial polarizer 202, which is the same as first and second coaxial polarizers 202*a*, 202*b* of FIG. 2, is illustrated having a rectangular shape and includes a first portion 210*a*, second portion 210*b* and a third portion 210*c*. The first and third portions 210*a*, 210*c* (or end portions) can include notched regions (or notched rectangular regions) 212*a*, 212*b* respectively. Second portion 210*b* (or middle portion) can be formed in a generally rectangular shape and couple first and third portions 210*a*, 210*c*. In an embodiment, the shape of notched regions (i.e., the notched shape) of first and second coaxial polarizers 202*a*, 202*b* can provide sufficient phase shift and good matching with a shorter length than a polarizer not having a notched shape.

Coaxial polarizer 202 can include one or more materials having a high dielectric constant, such as but not limited to high-k dielectric material having a high dielectric constant (e.g., Hi-K material).

Now referring to FIGS. 2C-2D, different views of coaxial OMT 204 are provided without ports attached (e.g., first port 206 and second port 208 of FIG. 2). As illustrated in FIG. 2B, coaxial OMT 204 includes a first cavity 212, a second cavity 214 and a hollow region 216 formed within and extending a length of coaxial OMT 204. First cavity 212 and second cavity 214 can be configured to couple with and receive a port, such as first port 206 and second port 208 of FIG. 2. In an embodiment, first cavity 212 and second cavity 214 can be communicatively coupled with hollow region 216 to transmit and receive signals in the low frequency band.

Figure 2E:
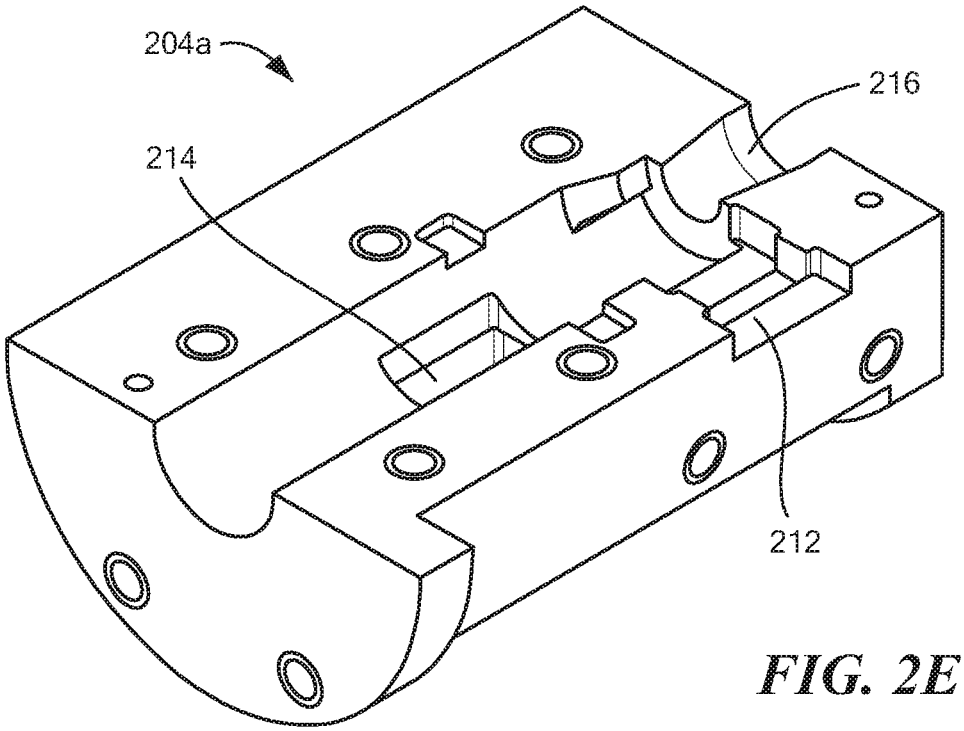
FIGS. 2E-2F are cut-away views of the OMT of the tri-band feed assembly of FIG. 1.
Figure 2F:
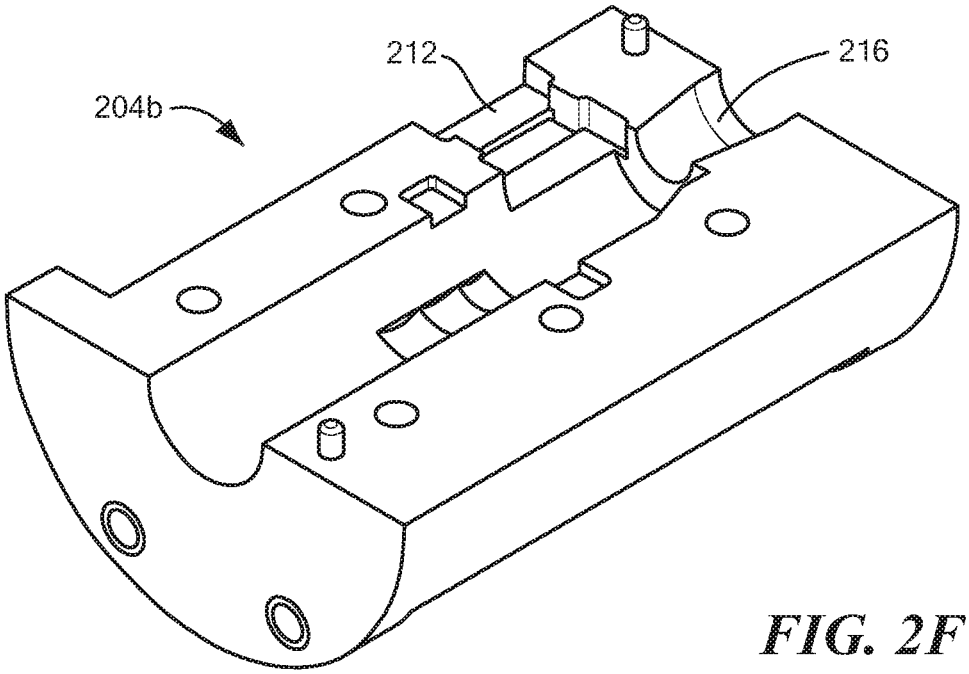
Figure 2G:
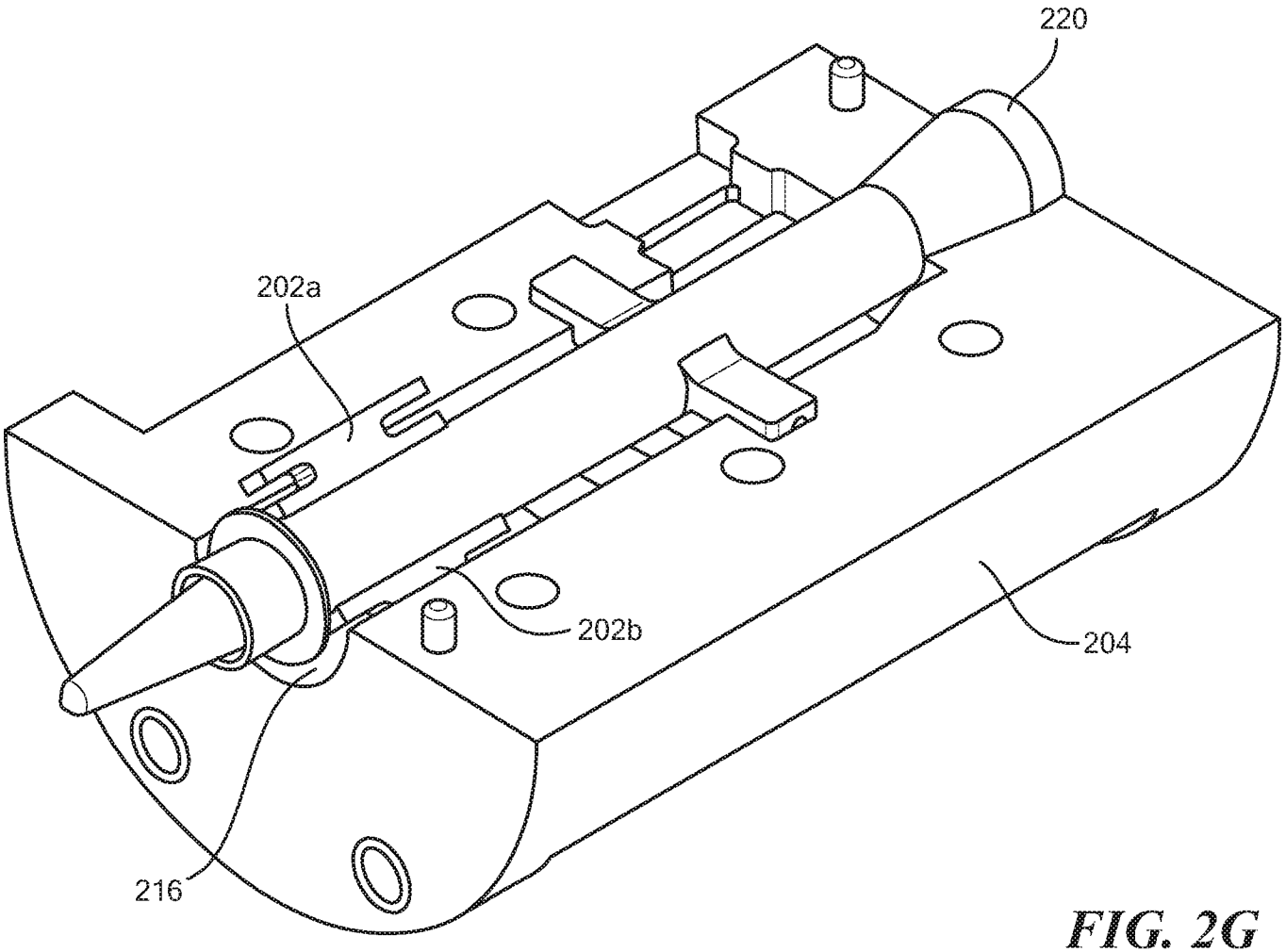
FIG. 2G is a cut-away view of a center conductor disposed within the coaxial OMT of the tri-band feed assembly of FIG. 1.

Now referring to FIGS. 2E-2F, a first half 204*a* and a second half 204*b* of coaxial OMT 204 are shown. Each of first and second halves 204*a*, 204*b* include a half of first cavity 212 to couple with and receive a first port (e.g., first port 206 of FIG. 2) and a half of second cavity 214 to receive a second port (e.g., second port 208 of FIG. 2). First and second halves 204*a*, 204*b* further include a half of hollow region 216 (here having a generally cylindrical shape), such that when first and second halves 204*a*, 204*b* are coupled together hollow region 216 of FIGS. 2C-2D is formed. Hollow region 216 can be configured to hold a center conductor of the feed assembly. For example, and as illustrated in FIG. 2G, a center conductor 220 can be disposed within hollow region 216 of coaxial OMT 204. First and second coaxial polarizers 202*a*, 202*b* are coupled to an outer surface of center conductor 220.

Now referring back to FIG. 2, coaxial OMT 204 can be formed such that first port 206 and second port 208 are disposed at a predetermined distance from each other. The predetermined distance can be based at least in part on a return loss threshold and an isolation threshold of a reflector antenna coaxial OMT 204 is coupled to. In one embodiment, the overall length of coaxial OMT 204 can be approximately 1.75 wavelengths at low band and separation between two ports (i.e., first and second ports 206, 208) can be less than 0.4 wavelength. However, it should be appreciated that the overall length of coaxial OMT 204 and separation between two ports can vary based at least in part on the requirements of a particular application.

Figure 3B:
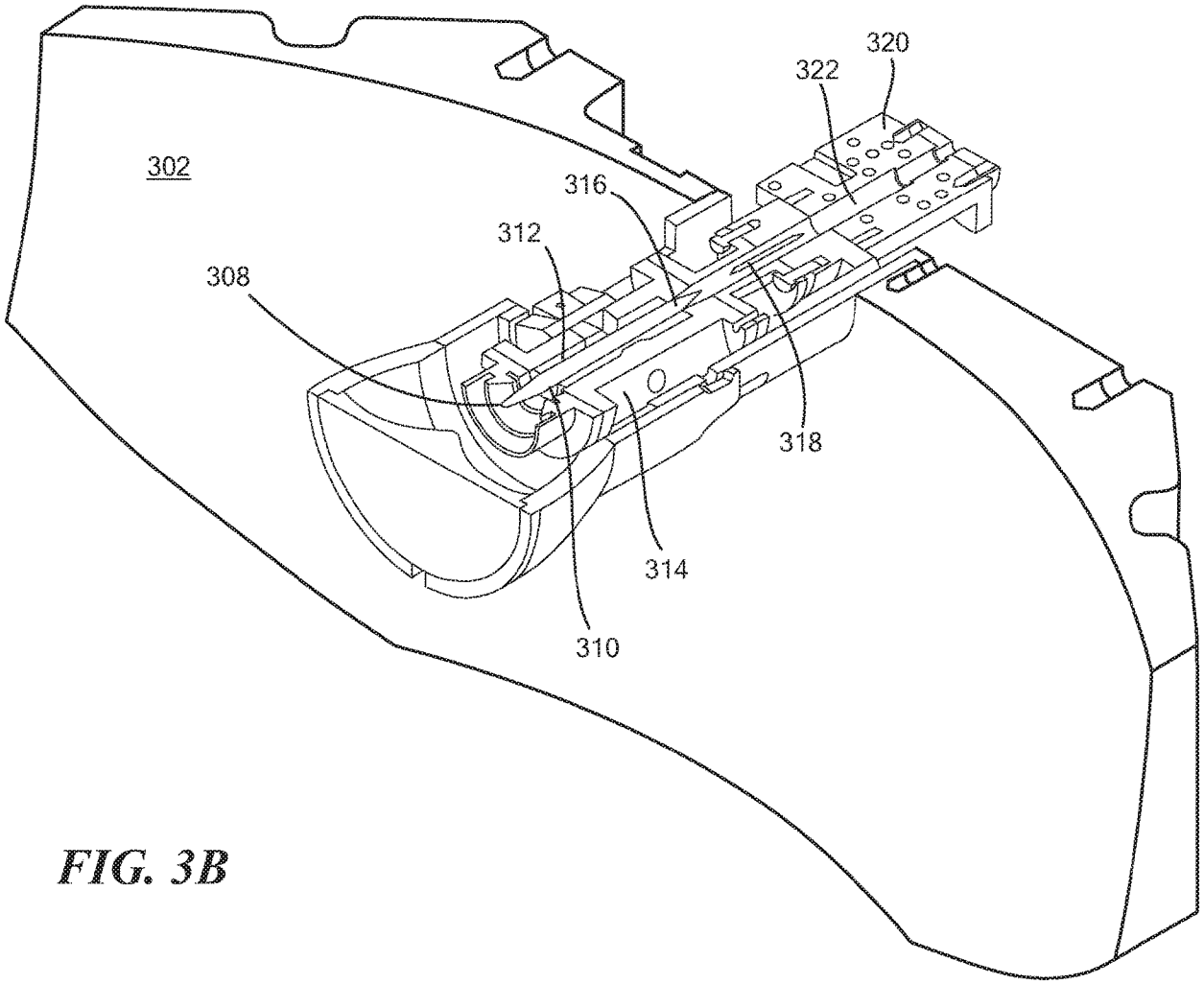

Referring now to FIGS. 3-3B, different views of a reflector antenna 302 coupled to a feed assembly 306 are shown. Feed assembly 306 includes a feed horn 308, matching section 310, coaxial polarizer 312, coaxial OMT 314, a polyrod 316, a polarizer 318, a diplexer 320, and a center conductor 322. Feed assembly 306 may be the same as or substantially similar to feed assembly 100 of FIG. 1.

Feed assembly 306 can be coupled to reflector antenna 302 to provide a tri-band feed such that reflector antenna 302 can transmit and/or receive signals in multiple frequency bands, such as low, mid and high frequency bands. In an embodiment, feed assembly 306 can be configured to have a common phase center for each of the different frequency bands and achieve high phase efficiencies for the reflector antenna 302 for all three bands. Feed assembly 302 can have equal or substantially equal beamwidths for each of the different frequency bands. In some embodiments, the 10-db beamwidths for the different frequency bands can be approximately 10 dB can be about 74 degrees.

Figure 4:
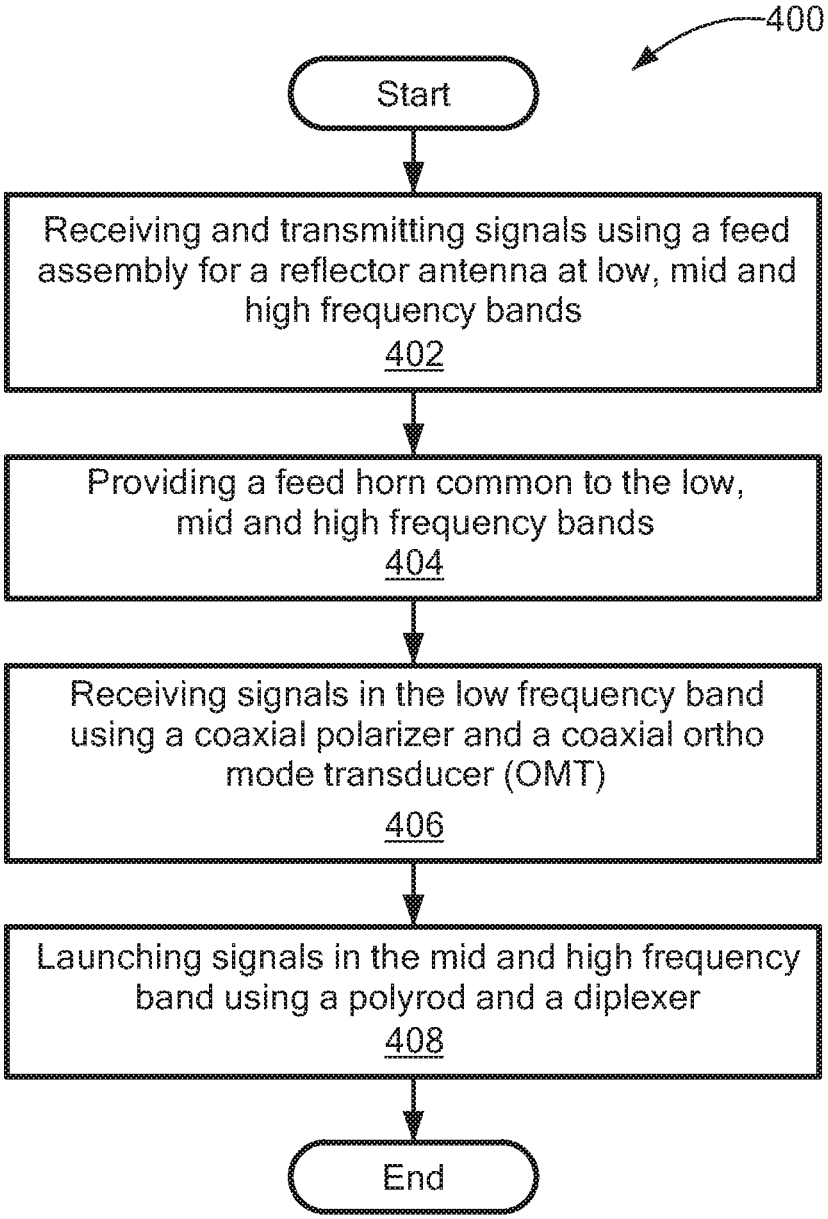
FIG. 4 is a flow diagram of a method for receiving and/or transmitting signals using the tri-band feed assembly of FIG. 1.

Referring now to FIG. 4, a flow diagram of a method 400 for receiving and/or transmitting signals using the tri-band feed assembly 100 of FIG. 1, begins at block 402 by receiving and transmitting signals using a feed assembly for a reflector antenna at low, mid and high frequency bands. The feed assembly can be coupled to the reflector antenna and be configured to support signals in each of the low, mid and high frequency bands (e.g., low—K (20.2-21.2 GHz), mid—Ka (30-31 GHz), and high—Q (43.5-45.5 GHz) bands).

At block 404, a feed horn common to the low, mid and high frequency bands can be provided. The feed assembly can include a feed horn that couples with the reflector antenna. The feed horn can be configured to launch signals in each of the low, mid and high frequency bands and thus convey (or transmit) signals received by the reflector antenna to other components within the feed assembly.

A matching section is coupled to the feed horn. The matching section can be configured to process signals in each of the low, mid and high frequency bands and convey them to a coaxial polarizer and coaxial OMT of the feed assembly.

At block 406, signals in the low frequency band can be launched using the coaxial polarizer and the coaxial OMT. The coaxial polarizer can apply a phase differential to a received signal to perform polarization conversion.

In some embodiments, one or more coaxial polarizer can be disposed on an outer surface of a center conductor. The coaxial polarizers and the center conductor can be disposed within an inner cavity of the coaxial OMT. The coaxial OMT can include multiple ports to launch signals in the low frequency bands. For example, in some embodiments, the coaxial OMT can include a first port for signals having left hand circular polarization properties and a second port for signals having right hand circular polarization properties.

At block 408, signals in the mid and high frequency bands can be launched using a polyrod and a diplexer. Signals having frequencies corresponding to the mid or high frequency bands be received at the polyrod. The polyrod can be disposed in the center conductor of the feed assembly such that a first end extends to the feed horn to receive the signals and a second end is disposed in a generally middle portion of the center conductor to convey the signals to other components (e.g., polarizer, diplexer) in the feed assembly. Each of the first and second end of the polyrod can include a tapered portion. The tapered portions of the polyrod can provide a gradual impedance change to minimize mismatch for both mid and high frequency bands. Thus, the polyrod can be configured to support signals in the mid and frequency band and convey them to a polarizer.

The polarizer can be configured to support signals in the mid and frequency bands and convey them to the diplexer. The diplexer can include multiple ports to separate signals in the mid frequency band from signals in the high frequency band. In some embodiments, the diplexer can include at least one mid band output port and at least one high band output port. The mid band output port can launch signal in the mid frequency band and the high band output port can launch signal in the high frequency band.

The feed assembly supports and launches signal in each of the low, mid and high frequency bands by including a portion for low frequency band signals and a portion for mid and high frequency band signals. For example, and as described herein, the coaxial polarizer and coaxial OMT can be configured to launch signals in the low frequency band and the polyrod, polarizer and diplexer can be configured to launch signals in the mid and high frequency bands. Thus, the feed assembly is a tri-band feed assembly.

Having described preferred embodiments, which serve to illustrate various concepts, structures and techniques, which are the subject of this patent, it will now become apparent that other embodiments incorporating these concepts, structures and techniques may be used. Accordingly, it is submitted that the scope of the patent should not be limited to the described embodiments but rather should be limited only by the spirit and scope of the following claims.

Accordingly, other embodiments are within the scope of the following claims.

What is claimed is:

1. A feed assembly for a reflector antenna comprising:

a feed horn common to low, mid and high frequency bands;

a coaxial polarizer to convert signals between circular and linear polarization in the low band frequency band and to support the mid and high frequency bands;

a coaxial orthomode transducer (OMT) to separate two orthogonal signals and transition from coaxial waveguide to rectangular waveguides in the low band frequency band and to support the mid and high frequency bands; and a polyrod disposed in a center conductor of the feed assembly, wherein the polyrod is common to the mid and high frequency bands and supports the low frequency band;

wherein the coaxial polarizer further comprises a portion having a notched rectangular shape.

2. The feed assembly of claim 1, wherein a length of the coaxial polarizer corresponds to one-half a wavelength of an operating frequency in the low frequency band.

3. The feed assembly of claim 1, wherein a length of the coaxial polarizer depends upon properties of a material forming the coaxial polarizer and a shape of the coaxial polarizer.

4. The feed assembly of claim 1, wherein the coaxial OMT further comprises at least two ports disposed at a predetermined distance, and wherein the predetermined distance corresponds to a return loss threshold and an isolation threshold of the reflector antenna.

5. The feed assembly of claim 1, further comprising a matching section coupled to the feed horn, the matching section common to the low, mid and high frequency bands.

6. The feed assembly of claim 1, further comprising a polarizer disposed in the center conductor of the feed assembly, the polarizer common to the mid and high frequency bands.

7. The feed assembly of claim 1, further comprising a diplexer configured to separate two ports for mid frequency band from a third port for high frequency band.

8. The feed assembly of claim 1, wherein respective 10-dB beamwidths for the low, mid and high frequency bands are approximately equal.

9. A feed assembly for a reflector antenna comprising:

a feed horn common to low, mid and high frequency bands;

a coaxial polarizer to convert signals between circular and linear polarization in the low band frequency band and to support the mid and high frequency bands;

a coaxial orthomode transducer (OMT) to separate two orthogonal signals and transition from coaxial waveguide to rectangular waveguides in the low band frequency band and to support the mid and high frequency bands; and a polyrod disposed in a center conductor of the feed assembly, wherein the polyrod is common to the mid and high frequency bands and supports the low frequency band;

wherein respective 10-dB beamwidths for the low, mid and high frequency bands are approximately equal and wherein the respective 10-dB beamwidths are about 74 degrees.

10. The feed assembly of claim 1, further comprising a co-located phase center for launching signals in the low, mid and high frequency bands.

11. A method comprising:

receiving and transmitting signals using a feed assembly for a reflector antenna at low, mid and high frequency bands;

providing a feed horn common to the low, mid and high frequency bands;

receiving signals in the low frequency band using a coaxial polarizer and a coaxial orthomode transducer (OMT), wherein each of the coaxial polarizer and the coaxial OMT support the mid and high frequency bands;

launching signals in the mid and high frequency band using a polyrod and a diplexer, wherein the polyrod and the diplexer support the low frequency band; and forming a portion of the coaxial polarizer further having a notched rectangular shape.

12. The method of claim 11, further comprising providing the coaxial polarizer at a length that corresponds to one-half a wavelength of an operating frequency in the low frequency band.

13. The method of claim 12, wherein the length of the coaxial polarizer corresponds to properties of a material forming the coaxial polarizer and a shape of the coaxial polarizer.

14. The method of claim 11, further comprising disposing first and second ports of the coaxial OMT at a predetermined distance corresponding to a return loss threshold and an isolation threshold of the reflector antenna.

15. The method of claim 11, further comprising providing a polarizer in a center conductor of the feed assembly, the polarizer common to the mid and high frequency bands.

16. The method of claim 11, wherein the diplexer is configured to separate two ports for mid frequency band from a third port for high frequency band.

17. The method of claim 11, wherein respective 10-dB beamwidth for the low, mid and high frequency bands are approximately equal.

18. The method of claim 11, further comprising a co-located phase center for launching signals in the low, mid and high frequency bands.

19. The feed assembly of claim 9, wherein a length of the coaxial polarizer corresponds to one-half a wavelength of an operating frequency in the low frequency band.

20. The feed assembly of claim 9, wherein a length of the coaxial polarizer depends upon properties of a material forming the coaxial polarizer and a shape of the coaxial polarizer.

21. The feed assembly of claim 9, wherein the coaxial OMT further comprises at least two ports disposed at a predetermined distance, and wherein the predetermined distance corresponds to a return loss threshold and an isolation threshold of the reflector antenna.

22. The feed assembly of claim 9, further comprising a matching section coupled to the feed horn, the matching section common to the low, mid and high frequency bands.

23. The feed assembly of claim 9, further comprising a polarizer disposed in the center conductor of the feed assembly, the polarizer common to the mid and high frequency bands.

24. The feed assembly of claim 9, further comprising a diplexer configured to separate two ports for mid frequency band from a third port for high frequency band.

25. The feed assembly of claim 9, further comprising a co-located phase center for launching signals in the low, mid and high frequency bands.

* * * * *